US009016297B2

(12) United States Patent
Salomon

(10) Patent No.: US 9,016,297 B2
(45) Date of Patent: Apr. 28, 2015

(54) WHEELED SUPPORT CANE

(71) Applicant: Gregg Salomon, Attleboro, MA (US)

(72) Inventor: Gregg Salomon, Attleboro, MA (US)

( * ) Notice: Subject to any disclaimer, the term of this patent is extended or adjusted under 35 U.S.C. 154(b) by 106 days.

(21) Appl. No.: 13/834,442

(22) Filed: Mar. 15, 2013

(65) Prior Publication Data

US 2014/0261594 A1 Sep. 18, 2014

(51) Int. Cl.

| | |
|---|---|
| ***A45B 1/02*** | (2006.01) |
| ***A61H 3/04*** | (2006.01) |
| ***A61H 3/02*** | (2006.01) |
| ***A45B 9/00*** | (2006.01) |

(52) U.S. Cl.

CPC .. *A45B 1/02* (2013.01); *A61H 3/02* (2013.01); *A45B 9/00* (2013.01); *A45B 2009/005* (2013.01)

(58) Field of Classification Search

CPC ..... A61H 3/02; A61H 3/04; A61H 2003/046; A45B 1/02; A45B 3/00; B62B 3/14

USPC ..... 135/65–68, 70, 84–85, 912; 280/87.01, 280/87.021, 87.041, 47, 62–65, 654, 652; 482/66–69

See application file for complete search history.

(56) References Cited

U.S. PATENT DOCUMENTS

| | | | | |
|---|---|---|---|---|
| 2,244,869 | A | 6/1941 | Jennings | |
| 2,792,874 | A | 5/1957 | Sundberg | |
| 3,350,095 | A | 10/1967 | Clasen | |
| 3,995,650 | A | 12/1976 | DiVito | |
| 4,046,374 | A | 9/1977 | Breyley | |
| 4,892,279 | A | 1/1990 | Lafferty | |
| 4,932,719 | A * | 6/1990 | Gonzalez y. Rojas | 297/338 |
| 5,020,560 | A | 6/1991 | Turbeville | |
| 5,056,545 | A | 10/1991 | Spaeth | |
| 5,320,122 | A | 6/1994 | Jacobson | |
| 5,390,687 | A | 2/1995 | Tsai | |
| 5,588,457 | A | 12/1996 | Tartaglia | |
| 5,692,533 | A * | 12/1997 | Meltzer | 135/65 |
| 5,775,352 | A | 7/1998 | Obitts | |
| 5,806,548 | A * | 9/1998 | Goldstein et al. | 135/65 |
| 6,158,453 | A | 12/2000 | Nasco | |
| 6,634,660 | B2 * | 10/2003 | Miller | 280/87.021 |
| 6,708,705 | B2 | 3/2004 | Nasco, Sr. | |
| 6,733,018 | B2 * | 5/2004 | Razon | 280/87.021 |
| 6,742,523 | B2 * | 6/2004 | Dubats | 128/875 |
| 7,252,105 | B2 | 8/2007 | Otis | |

(Continued)

FOREIGN PATENT DOCUMENTS

| | | | | |
|---|---|---|---|---|
| JP | 2005118153 A * | 5/2005 | | A61H 3/04 |
| JP | 2007105069 A * | 4/2007 | | |

OTHER PUBLICATIONS http://www.alibaba.com/product-free/100373110/Walking_Stick_Cane.html.

(Continued)

*Primary Examiner* — Winnie Yip

(74) *Attorney, Agent, or Firm* — Marc E. Hankin; Hankin Patent Law, APC; Kevin Schraven

(57) ABSTRACT

The present invention is a quad-wheeled and quad-legged cane. The cane typically includes one or more wheels, one or more rigid supporting structures, and one or more handles. The wheels of the cane are preferably retractable. The rigid support structures preferably overhang the wheels and generally provides fail-safe braking. The handles may be adjustable.

14 Claims, 11 Drawing Sheets

(56) References Cited

U.S. PATENT DOCUMENTS

| | | | | |
|---|---|---|---|---|
| 7,261,113 | B2 * | 8/2007 | Tartaglia | 135/66 |
| 7,261,114 | B2 | 8/2007 | Karasin et al. | |
| 7,334,592 | B2 | 2/2008 | Tartaglia | |
| 7,708,651 | B2 | 5/2010 | Shin | |
| 7,726,327 | B2 * | 6/2010 | Battiston | 135/67 |
| 7,802,764 | B2 | 9/2010 | Leinen | |
| 7,992,584 | B1 | 8/2011 | Birnbaum | |
| 8,151,812 | B2 * | 4/2012 | Razon | 135/66 |
| 8,348,288 | B1 * | 1/2013 | Laughon, Sr. | 280/87.021 |
| 8,523,211 | B2 * | 9/2013 | Mailahn | 280/263 |
| 2001/0038186 | A1 | 11/2001 | Wychozowycz | |
| 2003/0094191 | A1 | 5/2003 | Lin | |
| 2005/0274405 | A1 * | 12/2005 | Tartaglia | 135/65 |

OTHER PUBLICATIONS http://www.axelamedicalsupplies.com/foundations/store/shopdetail.asp?params=AX1535TFI-Wheeled-Heavy-Duty-Large-Base-Quad-Cane-Left-Handed, (Mar. 15, 2013).
http://www.qvc.com/qvc.product.V26770.html?, (Mar. 15, 2013).
http://www.rehabmart.com/product/pilot-rolling-cane-11982.html, (Mar. 5, 2013).

* cited by examiner

WHEELED SUPPORT CANE

BACKGROUND OF THE INVENTION

The present invention generally relates to mobile assistive support devices. More particularly, the present invention relates to a quad-wheeled and quad-legged cane with retractable wheels, adjustable handles, and rigid support structures that provides fail-safe braking.

BACKGROUND OF THE INVENTION

Infirmed, injured, ill, and aged people often require additional support or stability assistance from walking aid canes. Walking aid canes are generally designed in two basic configurations: canes with fixed, blunt-end ferrules and canes with various wheel configurations. Canes that utilize fixed, blunt-end ferrules generally lack any wheels, but typically offer the most stability. However, the user of these canes typically must be lift the cane off the ground and repositioned himself or herself with each step. This, in turn, may cause a brief period of non-support, during which the infirmed user may fall. Weak users of these canes may also tire due to the prolonged use of the constant lifting for repositioning. This, in turn, may also lead to repetitive stress injury and limited mobility. On the other hand, canes with wheels and/or support legs generally do not require a user to lift the cane for repositioning the cane during use. Thus, these types of canes can provide continuous support while minimizing the potential for repetitive stress injury.

Ordinary wheeled canes often require the user to have an intact sense of balance. When leaning on the cane, or applying a force in the direction where the wheels are facing, the user may cause the cane to unexpectedly roll in that direction, thereby causing the user to fall and/or become injured. Some of the canes have tried to mitigate this issue by adding user actuated breaking systems, such as with a hand brake, spring mounted leg brake, or a brake activated by significant applied downward force while the cane is perpendicular to the ground.

Current wheeled canes are significantly limited because they rely on the user's physical and mental response capacity to activate the brake to prevent a slide or fall. Unfortunately, the infirmed persons who need canes frequently do not have the reflexes necessary to activate the brakes in a consistently safe manner. Instead of stopping and stabilizing an off kilter infirm user, the canes frequently continue the momentum and cause even more injury than if the user had no cane at all. The spring-mounted leg brakes currently available do not stop the cane from sliding because the user does not react in the split second given to properly actuate the break.

This same problem also applies to canes with hand brakes. When the wheel(s) with the brake is off the ground (because the cane is not perpendicular to the ground due to the user leaning or loss of balance) the brake system is rendered ineffective. Indeed, the chances that the user will actually have time to use the brake is remote during a fall. Rather that activate the brake, most people react to the imbalance by tightly griping the cane handle(s) to try and stop a fall. Because wheeled canes with brakes require the user to react extraordinarily quickly, these wheeled canes do not passively arrest the imbalance and eventual fall of a user. That is, they are not "fail safe."

Another problematic situation arises when a user tries to utilize wheeled canes at an angle such as attempting to exit a vehicle, climb a curb, climb stairs, or go up or down a hill or ramp. In these situations, the wheel(s) is often the first and only surface to initially contact the ground. If the wheel does not have a fully engaged brake applied or if the support leg/brake is not fully actuated and touching the ground at the same time as the wheel, any force applied to that wheel will cause the cane to slide in the direction of the wheel, resulting in a potential serious fall and injury.

Accordingly, there is a need for an improved fail safe wheeled cane that aids in mobility, is easy to use, and that will, when utilized at an angle other than perpendicular to the ground surface or with a minimal downward force, cause the wheels to retract, such that the legs or base of the cane comes into contact with the ground and arrests the sliding of the wheels. Preferably, the leg or base of the cane is a stable, blunt-end ferrule or platform.

Regarding references that disclose wheeled and non-wheeled canes that fail to overcome the deficiencies discussed above, U.S. Pat. No. 4,044,784, issued to Smith, discloses a walking aid with a quad cane configuration blunt tipped legs without wheels. Smith is solely intended for support and not increased mobility or ease of use.

U.S. Pat. No. 4,997,001, issued to DiCarlo, discloses a convertible cane with one to multiple leg configurations through addition of legs to the base nexus by means of a fastener. DiCarlo lacks wheels on the ends and is solely for support and does not enhance mobility and is not easy to use.

U.S. Pat. No. 5,390,687, issued to Tsai, discloses a quad cane with detachable quadrupeds. Tsai has no wheels and thus fails to enhance the mobility of the user.

U.S. Pat. No. 2,244,869, issued to Jennings, discloses a walking cane with a plurality of legs including wheels. Jennings is very bulky and not very maneuverable. The legs of the Jennings cane are widely spaced apart and the wheels and legs are set up like a bike with a kickstand. This configuration requires the user to lean to the side in order to engage the ferrule. This unnecessary and dangerous leaning by the user diminishes stability and safety.

U.S. Pat. No. 5,271,422, issued to Sorrell, discloses a safety walker having front legs and rear wheels with backward resistant motion. The Sorrell walker also has a seat to prevent falling when using the device. This device is not a cane; is very bulky and heavy; and is designed for a much less mobile person.

U.S. Pat. No. 5,692,533, issued to Meltzer, discloses a combination quad walking cane with two wheels in the front and two blunt legs in the back. Meltzer discloses no means to safely disengage the wheels if the user were to use the cane on stairs or other surface non-level surface. Furthermore, if the user tilts the can away from the blunt legs, a slip may result while only the wheels are engaged.

U.S. Pat. No. 6,158,453, issued to Nasco, discloses a quad-wheeled cane with a front mounted brake. Essentially the base of Nasco looks like the old four-wheeled skates with a brake in front that is engaged by tilting the back of the skate upward. Nasco is very unstable and takes significant coordination to use safely. Simply put, the Nasco may create more problems than it solves.

U.S. Pat. No. 7,252,105, issued to Otis, discloses a two-wheeled cane, wherein the wheels are in-line and very spaced apart. The wheels are not retractable and have a front and back brake that are engaged by tilting the cane. Not only does this device is lack the stability of a quadruped, but it is hard to imagine the user being able to engage the brakes because it is almost impossible to tilt the cane while using the cane for support. Again, this cane creates more problems than it solves.

U.S. Pat. No. 6,708,705 issued to Nasco, discloses a tri-wheeled cane with a breaking method that is utilized when a downward force is applied to the wheelbase. Pyramidal canes have a higher center of gravity and are therefore less stable than quad canes. Since no legs or bumpers extend beyond the wheelbase, utilizing this three-wheeled cane at an angle will cause slippage without the ability to safely engage the brake.

U.S. Pat. No. 7,261,114, issued to Karasin, and U.S. Pat. No. 7,334,592, issued to Tartagila, disclose similar breaking, four-wheeled canes with a spring mounted brake and dual cane handle extending from the wheelbase. Downward force applied, or similar method, triggers a blunt foot attachment to drop down between the two front wheels thus acting like a brake. These references are deficient because they have no passive failsafe brake. The user must trigger the brake using quick reflexes that most cane users lack. If a slip or loss of balance occurs when the user is not in a position to properly actuate the brake thru downward force on the front handle or through the trigger mechanism, the brake will not be applied and the user will be injured in a bad fall.

The limitations of the currently available canes are further discussed in Bateni H, Maki B E., *Assistive Devices for Balance and Mobility: Benefits, Demands, and Adverse Consequences*, Arch Phys Med Rehabil 2005, 86:134-45, the contents of which are expressly incorporated herein by this references.

Thus, what is need is a quad wheeled and quad footed cane with retractable wheels and a fail-safe brake.

SUMMARY OF THE INVENTION

To minimize the limitations in the prior art, and to minimize other limitations that will become apparent upon reading and understanding the present specification, the present invention discloses a quad-wheeled and quad-legged cane, wherein the wheels are retractable and overhang a rigid support structure that allows for fail-safe braking and wherein the cane has one or more adjustable handles.

One embodiment of the invention is a cane comprising: at least one substantially vertical member; at least one handle; a base; at least one wheel; and at least one rigid supporting structure. The base is comprised of at least one wheel base; wherein the at least one handle is attached to a top end of the at least one substantially vertical member. The at least one vertical member is attached to a top surface of the base. The at least one wheel is attached to the at least one wheel base. The at least one rigid supporting structure is attached to the base distally to the at least one wheel. The at least one wheel extends from a bottom surface of the base and wherein the at least one wheel extends further away from the base than the at least one rigid supporting structure such that the cane rolls along a ground surface being traversed by a user without the at least one rigid supporting structure contacting the ground surface, and such that when the cane is tilted away from a substantially vertical position the at least one rigid supporting structure contacts the ground surface. The at least one wheel is retractable into the at least one wheel base such that when a force is applied downward on the at least one substantially vertical member, the at least one wheel retracts into the at least one wheel base such that the at least one rigid support structure contacts the ground surface; and wherein the at least one rigid supporting structure is a fail-safe brake. Preferably, there are four wheels, four wheel bases, and four rigid supporting structures. Preferably, the base is substantially rectangular and has four corners. Preferably, the four wheel bases are positioned substantially at the four corners of the base. Preferably, the four rigid supporting structures are positioned substantially at the four corners of the base and extend distally beyond the four wheels such that when the cane is tilted away from the substantially vertical position in any direction one or more of the four rigid supporting structures will come into contact with the ground surface. Preferably, each of the four rigid support structures is comprised of a flexible base and a substantially flat bottom, such that the four rigid support structures provide substantial braking and stability when one or more of the four wheels are retracted. Preferably, the at least one vertical member is comprised of two vertical shafts, wherein a height of each of the two vertical shafts is independently adjustable. Preferably, the handle is slideably attached to the two vertical shafts such that the handle may shift from a substantially level position to one or more tilted positions. Preferably, the two vertical shafts are removeably attached to the top surface of base. Preferably, the base is further comprised of a shaft connector. Preferably, the shaft connector is adjustable, such that the shaft connector shifts between a plurality of positions on the base, such that the cane may be used by both right handed and left handed users. Preferably, the two vertical shafts are removeably attached to the shaft connector of the base. Preferably, the one or more of the four wheel bases are comprised of an adjustment device. Preferably, the one or more adjustment devices allow a user to adjust the downward force needed to retract the wheels into the wheel bases. Preferably, the two of the four wheels are fixed axle wheels and wherein two of the four wheels are swivel wheels. The cane preferably further comprises one or more shaft stability bars; wherein the one or more shaft stability bars are slideably attached to both of the two vertical shafts and positioned below the handle. Preferably, the four wheel bases are further comprised of a compression spring; wherein the compression spring allows the four wheels to retract within the four wheel bases.

Another embodiment of the invention is a cane comprising: two substantially vertical shafts; at least one handle; a base; four wheels; and four supporting structures; wherein the base has four corners and is comprised of four wheel bases and a shaft connector; wherein the four wheel bases are positioned substantially at the four corners of the base; wherein the at least one handle is attached to a top end of each of the two substantially vertical members; wherein a lower end of each of the two vertical members are removeably attached to the shaft connector; wherein each of the four wheels is attached to the one of the four wheel bases; wherein the four rigid supporting structures are positioned substantially at the four corners of the base and extend distally beyond the four wheels; wherein the four wheels extend from a bottom surface of the base and wherein the four wheels extend further away from the base than the four rigid supporting structures such that the cane rolls along a ground surface being traversed by a user without the at least one rigid supporting structure contacting the ground surface, and such that when the cane is tilted away from a substantially vertical position in any direction one or more of the four rigid supporting structures will come into contact with a ground surface; wherein each of the four wheels retract into one of the four wheel bases such that when a force is applied downward on the vertical shafts, one or more of the wheels retract into the corresponding wheel base such that one or more of the four rigid support structures contact the ground surface; wherein the four rigid supporting structures are a fail-safe brake; and wherein a height of each of the two vertical shafts is independently adjustable. Preferably, the base is further comprised of a shaft connector. Preferably, the shaft connector is adjustable, such that the shaft connector shifts between a plurality of positions on the base, such that the cane may be used by both right handed and left handed users. Preferably, the two vertical shafts are removeably attached to the shaft connector of the base. Preferably, the handle is slideably attached to the two vertical shafts such that the handle may shift from a substantially level position to one or more tilted positions. Preferably, the one or more of the four wheel bases are comprised of an adjustment device. Preferably, the one or more adjustment devices allow a user to adjust the downward force needed to retract the wheels into the wheel bases. Preferably, the each of the four rigid support structures is comprised of a flexible base and a substantially flat bottom, such that the four rigid support structures provide substantial braking and stability when one or more of the four wheels are retracted. Preferably, the cane also includes one or more shaft stability bars; wherein the one or more shaft stability bars are slideably attached to both of the two vertical shafts and positioned below the handle. Preferably, the four wheel bases are further comprised of a compression spring; wherein the compression spring allows the four wheels to retract within the four wheel bases. Preferably, two of the four wheels are fixed axle wheels and wherein two of the four wheels are swivel wheels.

In another embodiment there is a cane attached to a base having at least one wheel and one vertical support shaft; the support shaft having an adjustable length and at least one handle at the top having an adjustable collar for level, inclined, and declined orientations; the base being comprised of a rigid material having a connection to the bottom of at least one support shaft; the shaft-base connection being adjustable allowing the user to adjust or attach a shaft proximal or distal along the base midline in either a left or right orientation allowing for left and right hand use; every wheel having contact with the ground surface and attached to a wheel assemble; a wheel assemble fixed to the bottom of the base allowing the wheel to retract when a downward force is applied with the cane in a position perpendicular to the ground surface, and with a front, in-line fined caster and rotatable rear wheel caster when in configurations of at least two wheels; at least one rigid structure fixed to the base and extending from the base to beyond the wheels in all directions and down to a small vertical distance above the ground such that each wheel is essentially surrounded by a fixed, rigid structure with a bottom of hard, non-slip material such a rubber for contact with the ground surface upon wheel retraction and forming a small angle as measure between the base of a wheel where it contacts the ground surface and the bottom edge of the nearest rigid structure when the wheel is not retracted.

In another embodiment of the present invention there is a cane with a fixed handle with a single shaft connecting to a rigid base; the base having at least one wheel assemble in which the wheel retracts into a rigid base support assemble in response to downward force applied thru the handle by the user; the distance from the contact point of the wheel against the ground surface in a non-retracted position to the proximal bottom edge of the surrounding support assemble forming a small angle and the distance between the surrounding support assemble edge and the ground surface being a small distance. The result being a safe and stable retractable wheel into a rigid support assemble allowing wheeled motion or stable support with downward pressure.

The present invention overcomes the limitations of the prior art and other deficiencies described by the prior art. In the aspect of the present invention, an assistive cane with adjustable collar/handles and one or more removable and adjustable shafts attached to a base comprised of a fixed based with one or more blunt ferrules extending beyond, or a surrounding platform, proximate to one or more adjustable tension, actuating, forward facing, rotating front wheels assemblies and fixed, in-line rear wheel assemblies. The ferrules or surrounding platforms extend past the wheel assemblies at the same relatively small angle in all directions relative to the center of the cane in its perpendicular position relative to the ground surface. Each ferrule or support platform is relatively close to the ground thus creating a small angle between the contact point of the wheel at the ground and the proximal ferrule or support base in its raised position. It is this small angle that provides greater safety to users since a wheel can only be in contact with the contact surface if the cane is at or very near perpendicular in orientation. In addition, if a small downward force is applied to the cane, the wheel will retract. The small distance between the rigid structure surrounding the wheel in all directions and the ground and relatively small downward force required means a reduced reaction time and force required to disengage any wheel in contact with the ground surface. This results in the current invention of a wheeled cane that offers added safety and easy disengagement of any wheel when used at any angle other than the intended perpendicular orientation of the cane relative to the ground surface. Furthermore, in an emergency situation like a slip or fall, there are no confusing actuations like applying a handbrake or other braking actions since a natural reaction by a user in that situation would be to simply grab the handle tightly to try and regain stability. Furthermore, it isn't likely that a user would be holding a wheeled cane in a perfectly perpendicular position relative to the ground during a fall, which would be required for optimum actuation of ordinary wheeled canes with this type of braking. It is more likely that they or the cane would be at an angle that may make it impossible to actuate a spring mounted brake with a downward force thus creating a potential for injury.

Having an adjustable compression force to the wheel retraction in both the front and rear wheels allows users of different weights and physical abilities to use this cane with the correct amount of force required to disengage the retractable wheels. The user will not easily alter the adjustment of the force during normal usage to prevent persons with impaired mental function from altering the correct settings based on the intended user's physical state and ability. Fixed rear wheels and rotating front wheels allows the greatest balance of control and mobility. Fixed rear wheels prevent rear sliding outward during usage while rotating front wheels allow for easy of turning without lifting the cane.

Duel, adjustable shafts with multiple handles will allow for a variety of configurations for handle position as well as correct adjustments for users of different heights. This allows the user to utilize the device in either a cane or crutch configuration.

It is an object of the present invention to overcome the limitations of the prior art. Many of these limitations are discussed in the *Assistive Devices for Balance and Mobility: Benefits, Demands, and Adverse Consequences* article that has been expressly incorporated herein.

It is an object of the present invention to provide an easy to use, sturdy, adjustable, and inexpensive walking aid cane. The cane has a fail-safe brake that is activated by a substantially downward force or the cane tilting past a certain angle.

These, as well as other components, steps, features, objects, benefits, and advantages, will now become clear from a review of the following detailed description of illustrative embodiments, the accompanying drawings, and the claims.

DETAILED DESCRIPTION OF THE DRAWINGS

The drawings are of illustrative embodiments. They may not illustrate all embodiments. Other embodiments may be used in addition or instead. Details that may be apparent or unnecessary may be omitted either to save space or to provide more effective illustration. Some embodiments may be practiced with additional components or steps and/or without all of the components or steps that are illustrated. When the same numeral appears in different drawings, it refers to the same or like components or steps.

In the following detailed description of various embodiments of the invention, numerous specific details are set forth in order to provide a thorough understanding of various aspects of one or more embodiments of the invention. However, one or more embodiments of the invention may be practiced without some or all of these specific details. In other instances, well-known methods, procedures, and/or components have not been described in detail so as not to unnecessarily obscure aspects of embodiments of the invention.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the screen shot figures, and the detailed descriptions thereof, are to be regarded as illustrative in nature and not restrictive. Also, the reference or non-reference to a particular embodiment of the invention shall not be interpreted to limit the scope of the invention.

The term "ferrule" is preferably defined herein as any stable and substantially blunt ended leg, foot, cap, or rigid supporting structure. The ferrule may be of any shape, but typically the bottom portion of the ferrule is substantially flat and generally wider than the top portion.

Figure 1:
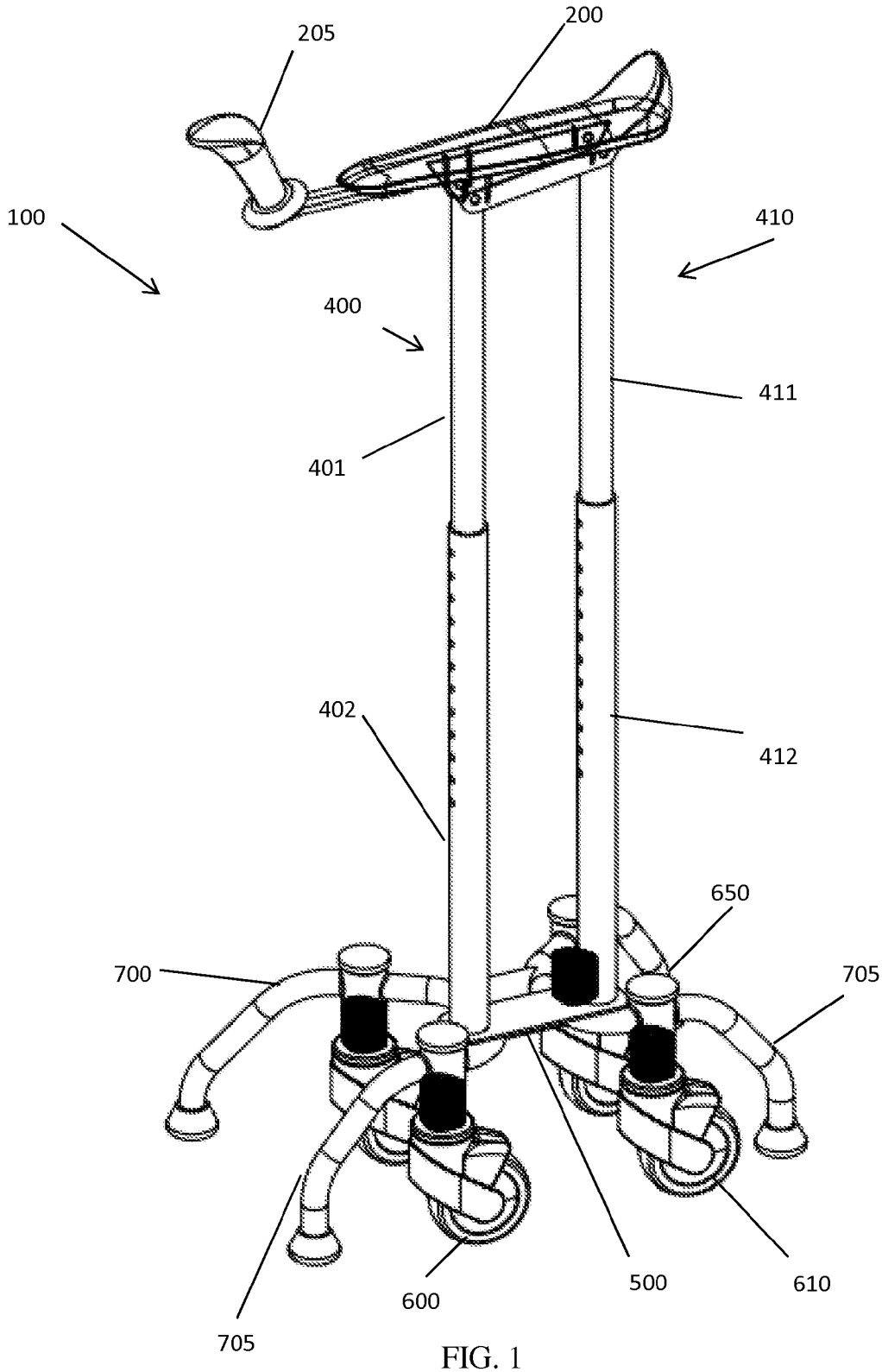
FIG. 1 is an illustration of a perspective view of one embodiment of the cane.

FIG. 1 is an illustration of a perspective view of one embodiment of the cane. As shown in FIG. 1, the cane 100 preferably comprises of: a handle 200; grip 205; vertical shafts 400, 410; upper shaft portions 401, 411; lower shaft portions 402, 412; base 500; front wheels 600; rear wheels 610; wheel bases 650; and rigid support structures 700, 705. The cane 100 is preferably any walking stick that is used as a crutch or mobility aid and may help redistribute weight from a weak or painful lower leg. Preferably, the cane 100 is substantially symmetrical and may be made out of a rigid, sturdy material capable of supporting a person's weight. The cane 100 may be light enough to be lifted or carried along short distances and may be constructed of any non-manmade or manmade material such as metal, aluminum, plastic, polymer, fiberglass, 25% to 40% fiberglass filled nylon or any combination or alloy. As preferred and shown in FIG. 1, the cane 100 has a rigid base 500 and a plurality of wheels. The wheels are generally sufficiently spaced for stability, such that cane 100 is stable, free-standing and upright when not utilized.

FIG. 1 also shows that the cane 100 typically has a set of two front wheels 600 and a set of two rear wheels 610, which are typically attached to the base 500 at wheel bases 650. The front wheels 600 and rear wheels 610 are preferably configured to swivel and lock into position, such that the front wheels 600 and rear wheels 610 do not swivel. Additionally, the two rotatable or swivel wheels 600 are generally attached to the base 500, preferably equidistant from an axis or midline in the front of the base 500. The two rear wheels 610 are also preferably in a fixed forward facing configuration, and generally attached to the base 500, such that the two rear wheels 610 are equidistant from the midline in the rear of the base 500. The front wheels 600 and rear wheels 610 are preferably offset equidistant from midline, but may be offset at unequal distances. The front wheels 600 and rear wheels 610 also may be placed in a configuration that provides the cane with the greatest stability regarding proximal placement of the rigid support structures 700 such as a wheel overhang, as shown in FIG. 1. The placement of the front wheels 600 and rear wheels 610 may depend on various factors such as the accommodation of a user's foot and the accommodation of the user's ability to utilize the cane 100 without stepping on or being tripped by the base 500, front wheels 600; rear wheels 610; and/or rigid support structures 700. As shown in FIG. 1, the rigid supporting structures 700 may provide stability when the cane is tilted beyond its natural or normal position. Although FIG. 1 shows four rigid supporting structures 700, it should be understood any number of rigid supporting structures 700 may be used without deviating from the scope of the invention. For maximum stability, a rigid supporting structure 700 is generally distally located next to each wheel.

FIG. 1 also shows the handle 200, which is preferably removeable, attached to a top end of each of the two substantially vertical shafts 400, 410. The two vertical shafts 400, 410 may be a single fixed length shaft, but are preferably two or more telescoping upper shaft portions 401, 411 and lower shaft portions 402, 412, as shown in FIG. 1. In this manner, the length of each of the substantially vertical shafts 400, 410 are preferably independently adjustable. The handle 200 may slidably and/or moveably attach to the two vertical shafts 400, 410, such that the handle 200 may shift from a substantially level position to one or more tilted positions (inclined or declined). The lower end of each of the two vertical shafts 400, 410 is preferably removeably attached to the top of the base 500.

FIG. 1 shows that the front wheels 600 and rear wheels 610 may extend further away from the base 500 than the four rigid supporting structures 700. This generally allows a user to move the cane 100 along a ground surface, thereby avoiding contact between the rigid supporting structures 700 and the ground surface. Preferably, when the cane 100 is tilted away from a substantially vertical position, one or more of the rigid supporting structures 700 will generally contact the ground surface. When a force is applied downward on the vertical shafts 400, 410, each of the wheels may retract into its wheel base 650 and one or more of the four rigid support structures 700, 705 may contact the ground surface. In this manner, the rigid supporting structures 700, 705 preferably function as fail-safe brakes for the cane.

Preferably, the cane 100 has two substantially vertical shafts 400, 410, but may comprise of more than two shafts without deviating from the scope of the invention. Furthermore, the upper shafts 401, 411 may interconnect telescopically with lower shafts 402, 412, by using a hole and (spring) pin system for adjusting the length of the vertical shafts 400, 410. Although FIG. 1 shows a hole and pin system used as an adjustment system, it should be understood that any adjustment system may be used without deviating from the scope of the invention.

Additionally, although not shown in FIG. 1, stability bars may be added to the cane 100. Specifically, the stability bars are generally horizontal and are connected to each of the vertical shafts 400, 410, and may be connected to the other parts of the cane 100 in various configurations. The stability bars are generally used to provide stability and may even be used to act as an extra handle for shorter cane users. Furthermore, the stability bars may be used to slide up and down the vertical shafts 400, 410 for adjustment, which typically allows the vertical shafts 400, 410 to move independently, allowing the handle 200 to tilt.

Figure 2:
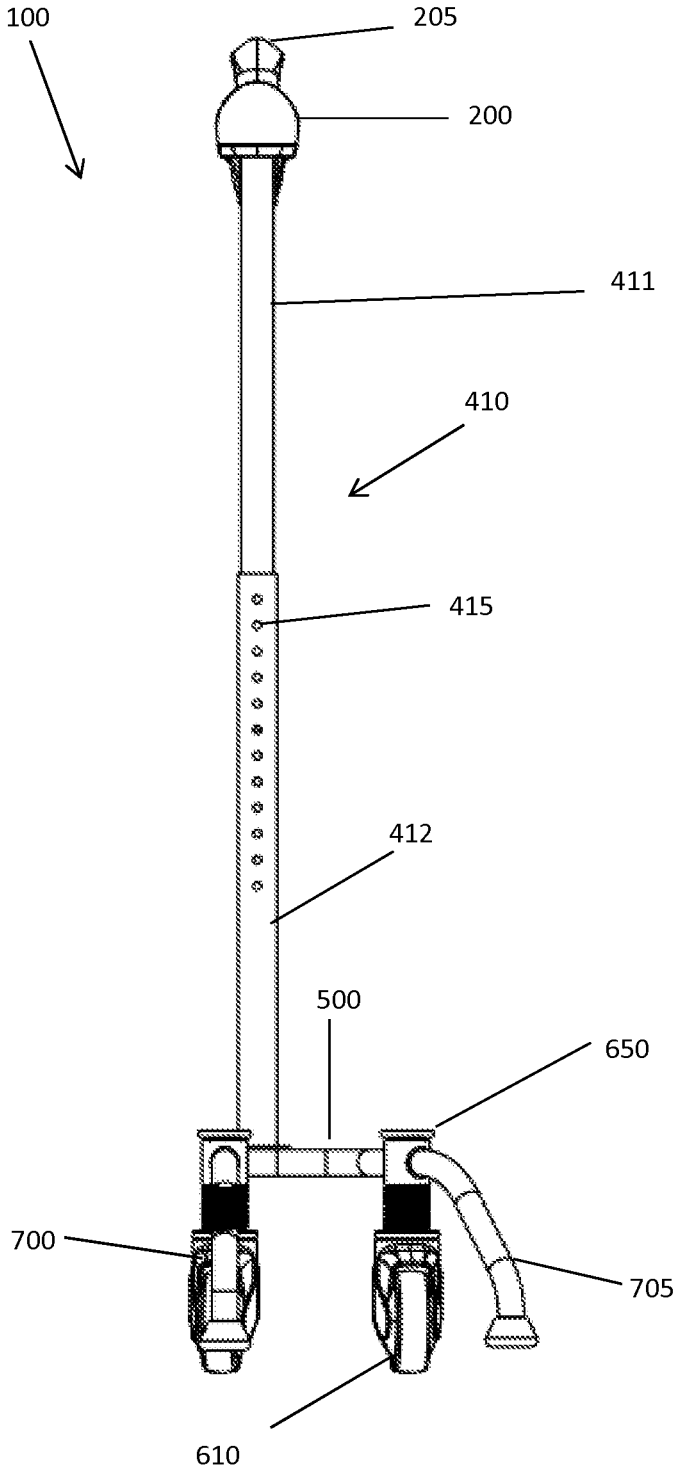
FIG. 2 is an illustration of a front view of one embodiment of the cane.

FIG. 2 is an illustration of a rear view of one embodiment of the cane. As shown in FIG. 2, the cane 100 preferably includes handle 200; grip 205; vertical shaft 410; upper shaft 411; lower shaft 412; holes 415; base 500; wheel bases 650; rear wheels 610; and rigid support structures 700 and 705. FIG. 2 shows how the shafts are preferably positioned on one side of the base 500, (depending on whether the user is using the cane with his or her right hand or left hand), and preferably shows the cane 100 being used by the right hand of a user. FIG. 2 also shows how the wheels of cane 100, in a substantially vertical and resting position, touch the ground while the rigid support structures 700 do not. This in turn preferably allows the user to gain support from the cane without lifting or dragging the cane when taking an assisted step. The vertical shafts 400, 410 are preferably attached onto the side of the wheel base 650 of cane 100 for maximum stability, and the vertical shafts 400, 410 are generally adjustable through the use of holes 415 and lock pins.

Figure 3:
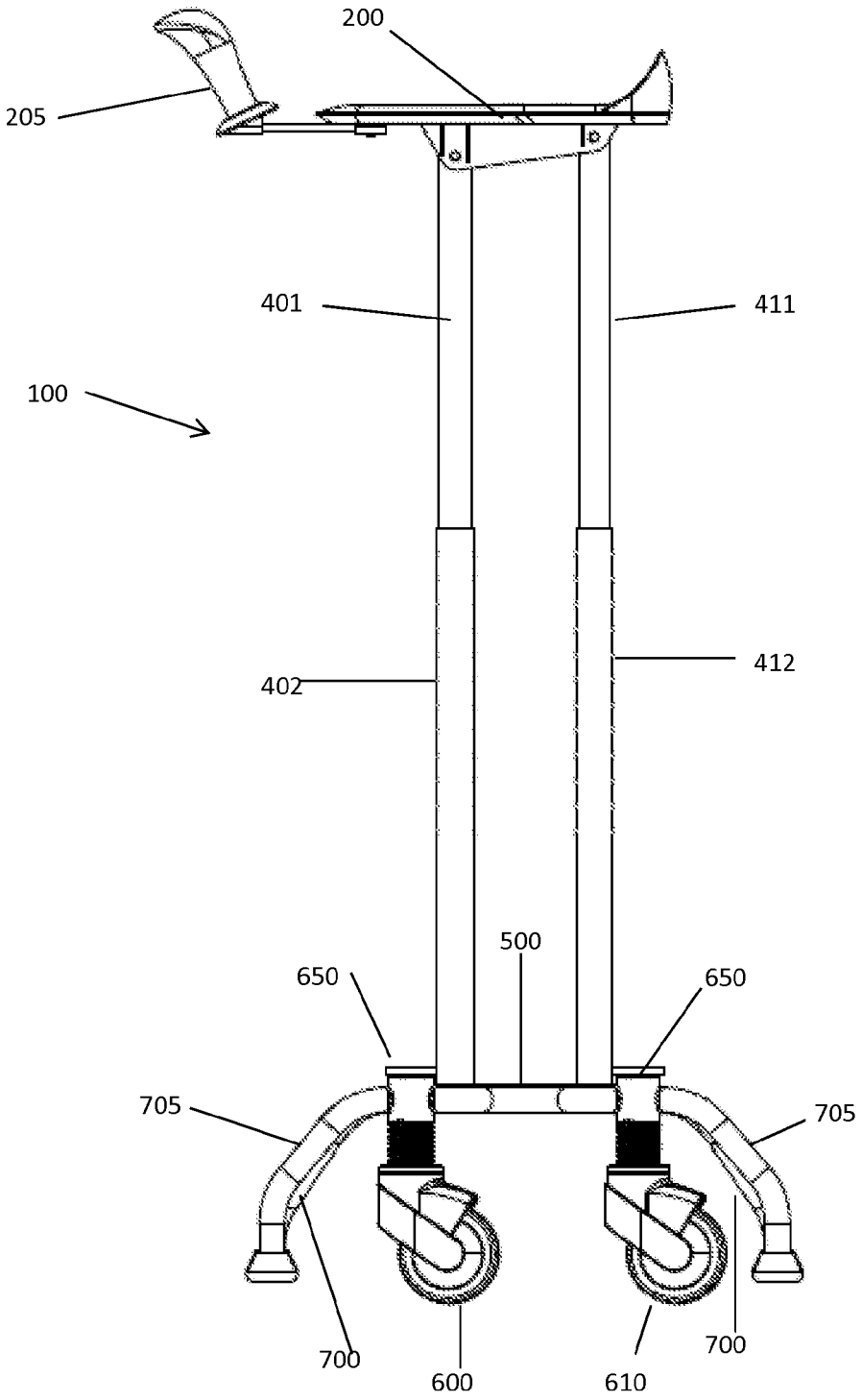
FIG. 3 is an illustration of a side view of one embodiment of the cane.

FIG. 3 is an illustration of a side view of one embodiment of the cane. As shown in FIG. 3, the cane 100 preferably includes: handle 200; upper shafts 401, 411; lower shafts 402, 412; base 500, wheel bases 650, front wheel 600, rear wheel 610, and rigid support structures 700 and 705.

Figure 4A:
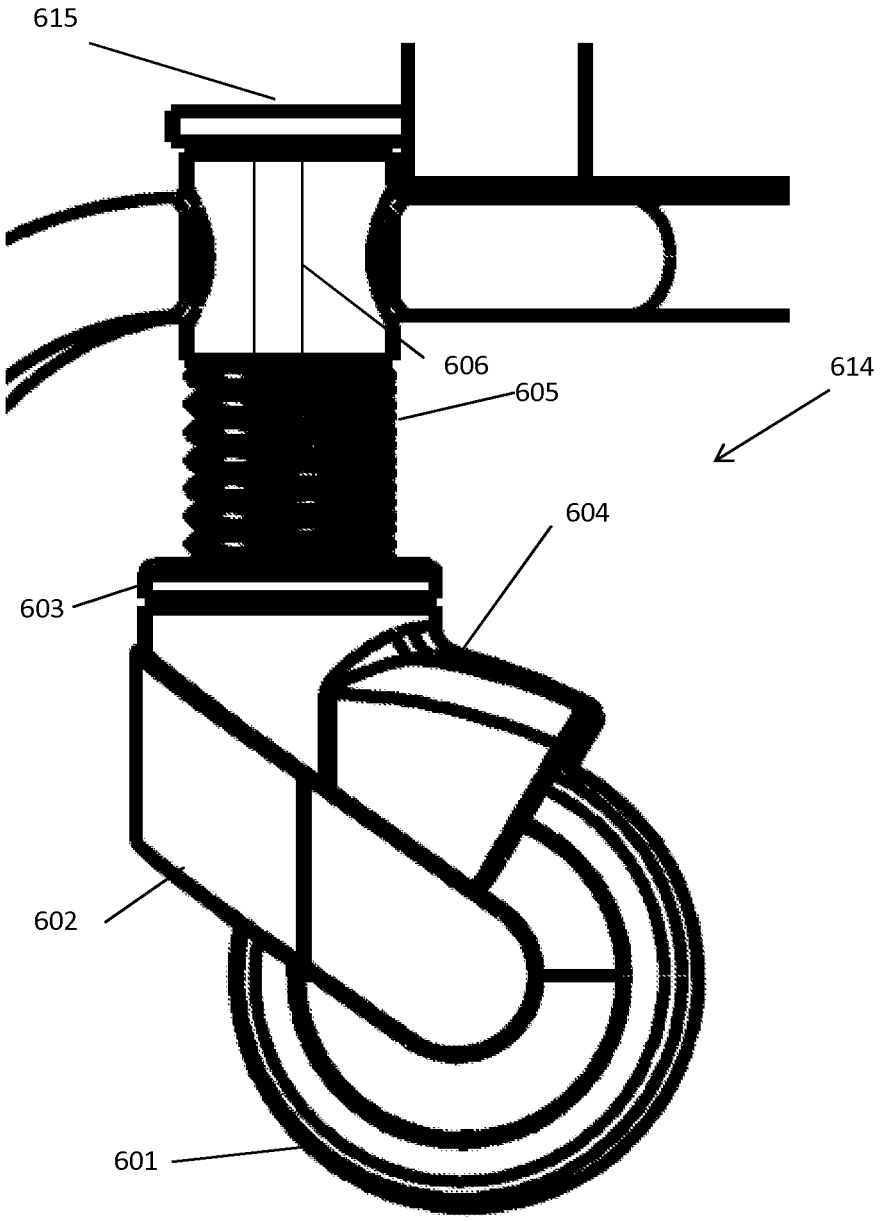
FIG. 4A is a detailed illustration of a side view of one embodiment of a wheel, showing the wheel in a normal position.

FIG. 4A is a detailed illustration of a side view of one embodiment of a wheel assembly, showing the wheel in a normal, or resting, position. As shown in FIG. 4A, the wheel assembly 614 preferably includes: wheel 601; wheel caster 602; sealed bearing assembly 603; top portion of the caster 604; compression spring 605, connection 606; and spring tension adjustment knob 615. The front wheel 600 is generally comprised of a wheel 601, or some other type of circular or spherical object, which is strong enough to support a user's weight and provide smooth turning on a variety of terrians. The wheel 601 is preferably made from any non-manmade material such as polyurethane, plastic, polymer metal, fiberglass, or some other combination of alloys, to provide a rigid, long lasting, slip resistant wheel. The sealed bearing assembly 603 preferably allows for 360-degree rotation of the wheel. The top portion of the caster 604 is preferably configured to slide into the wheel base 650 when downward force is applied to the base 500. Further, a tension adjustment knob 615 may be provided to allow a user to adjust the downward force needed to retract the wheels into the wheel bases and may be substituted or added by a compression bar.

Preferably, the wheel is retracted by a retraction system, which is preferably performed by the compression spring 605. However, other mechanisms for providing compression force against the top caster retraction into the wheel base 650 may be used. A connection 606 may be used to allow each caster to attach to the wheel base 650 and may be constructed of any metal, alloy or other significantly rigid and strong pin, bolt, or other mechanism. The wheel base 650 is preferably constructed from a rigid material such as metal, plastic, alloy, or composite, and may be cylindrical or other shape to accommodate the caster 602 and compression mechanism. Additionally, the wheel is preferably comprised of a tension adjustment knob 615 or other mechanism for manually increasing the compression force within each wheel base 650. The compression bar 608 may be constructed from a material that can withstand the forces applied and is appropriate to the design of the compression mechanism. The mechanism for providing significant compression force for retractable wheels assemblies are typically determined by force actuation requirements for typical users, quality of construction, costs, and size requirements. Although a compression spring 605 is shown as the preferred mechanism for providing the retraction, other systems and configurations for providing compression resistance may be used such as a gas or hydraulic filled chambers, or materials under compression.

Figure 4B:
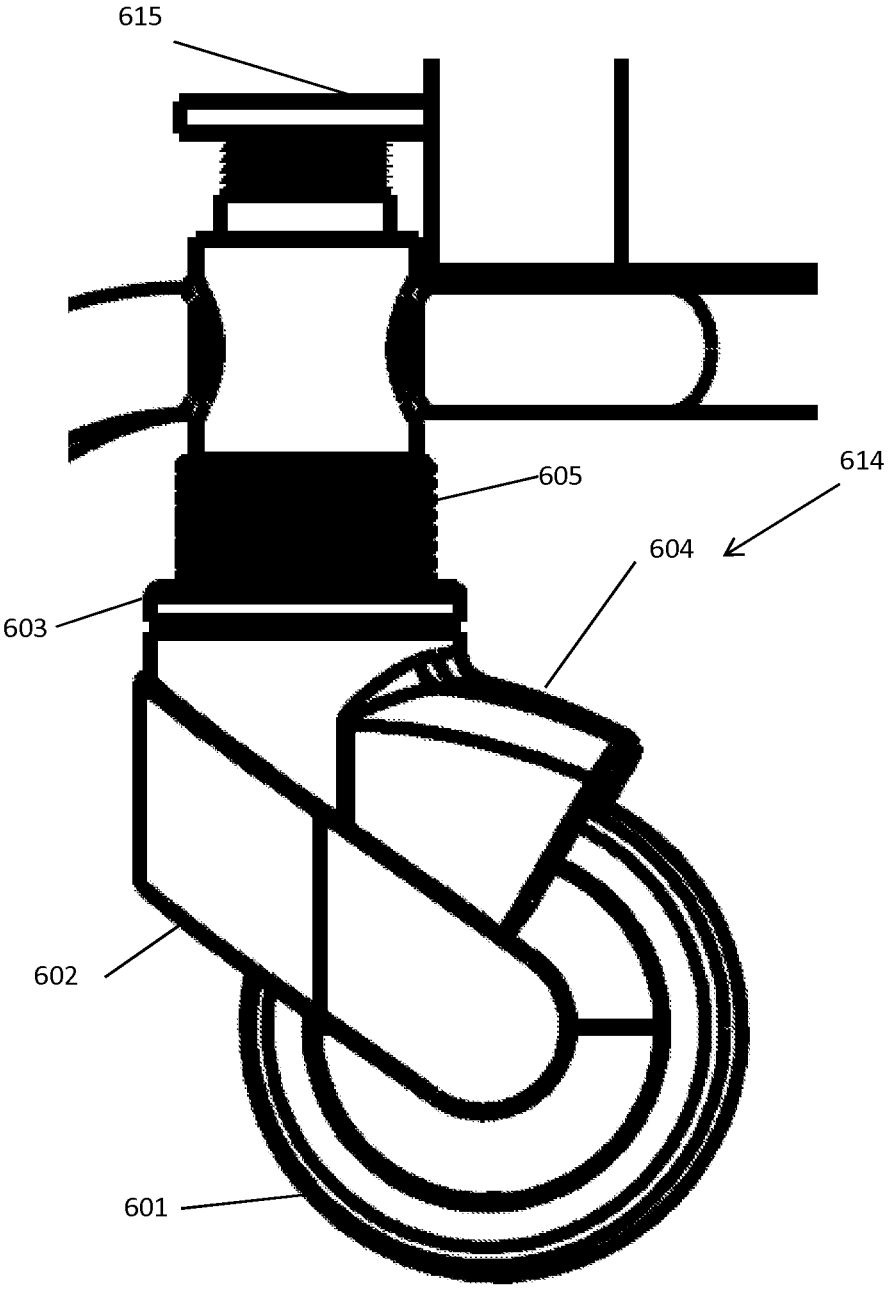
FIG. 4B is a detailed illustration of a side view of one embodiment of the wheel, showing the wheel in a retracted position.

FIG. 4B is a detailed illustration of a side view of one embodiment of the wheel, showing the wheel in a retracted position. As shown in FIG. 4B, the wheel assembly 614 preferably includes: wheel 601; wheel caster 602; sealed bearing assembly 603; top portion of the caster 604; compression spring 605, connection 606; and spring tension adjustment knob 615.

Figure 5:
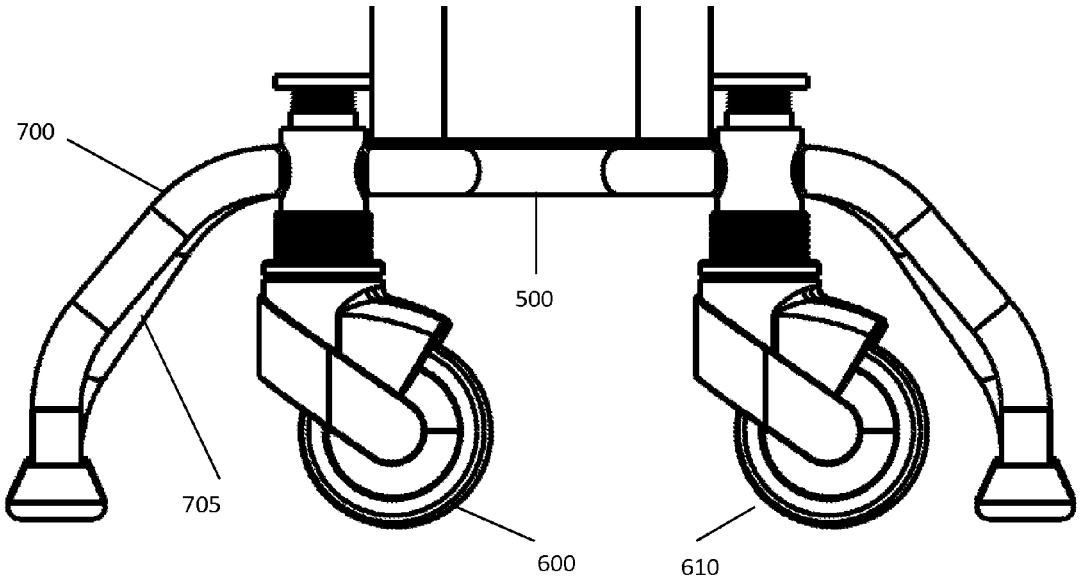
FIG. 5 is a detailed illustration of a side view of the base of one embodiment of the cane and shows the wheels in a retracted position.

FIG. 5 is a detailed illustration of a side view of the base of one embodiment of the cane and shows the wheels in a retracted position. As shown in FIG. 5, a downward force, which is typically caused by significant weight of the user pushing down on the vertical shafts 400, 410, and thus down on the base 500, generally causes the wheels 600, 610 to retract and allow rigid support structures 705 to contact the ground. Preferably, when the rigid support structures 705 are fully in contact with the ground, no movement, motion, or wheel slippage, is possible unless and until the downward force stops and the base is held upwards by the wheels, thereby raising the rigid support structures 705 off the ground.

Figure 6:
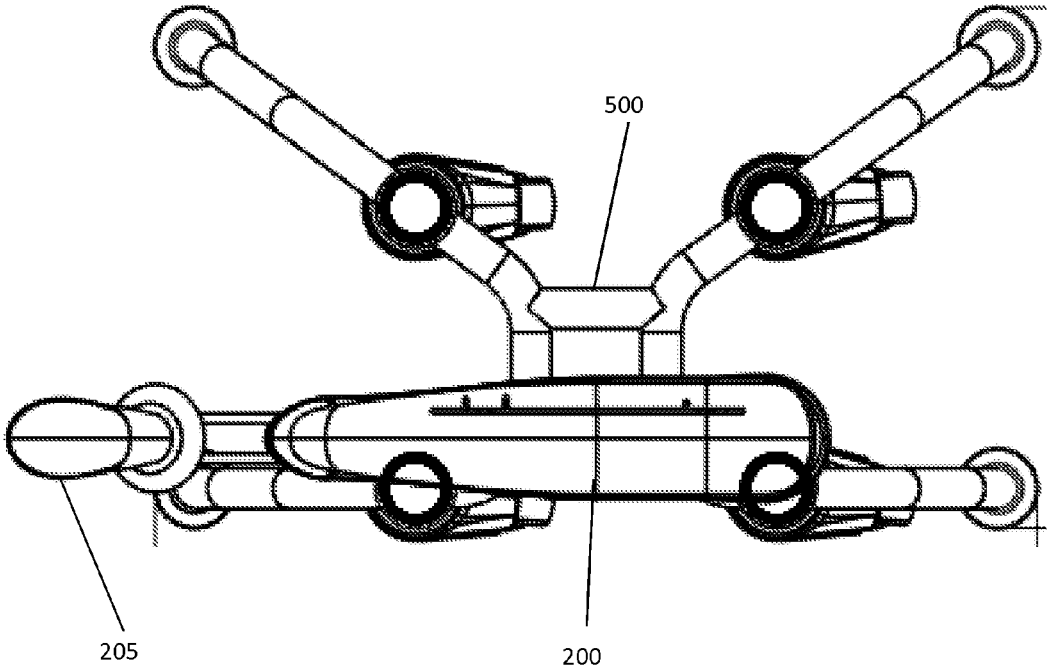
FIG. 6 is an illustration of a top view of one embodiment of the cane.

FIG. 6 is an illustration of a top view of one embodiment of the cane. As shown in FIG. 6, the cane 100 is preferably comprised of a base 500 with a handle 200 that is adjustable such that the cane 100 may be used by right handed or left handed users. The handle 200 is preferably used to allow the user to hold or grasp the cane 100 with the left hand or right hand of the user. For example, if the handle 200 and vertical forward grip 205 were rotated, the right handed cane shown by FIG. 6 may convert to a left handed cane. Similarly, if the handle 200 and vertical forward grip 205 were rotated the opposite direction, the left handed cane may convert to a right handed cane. In order to switch from a right-handed cane to a left-handed cane, the user generally separates the handle 200 and vertical forward grip 205 from the cane 100 and replaces the handle 200 and vertical forward grip 205 in a reversed position.

Regarding the base 500, the base 500 is preferably asymmetrical which allows the cane to be usable by both left and right hands, without requiring significant structural changes, such as movement of vertical shafts 400, 410. The asymmetry also provides significant support without the base, wheels, and rigid support structures from interfering with the walking motion of the user.

Figure 7:
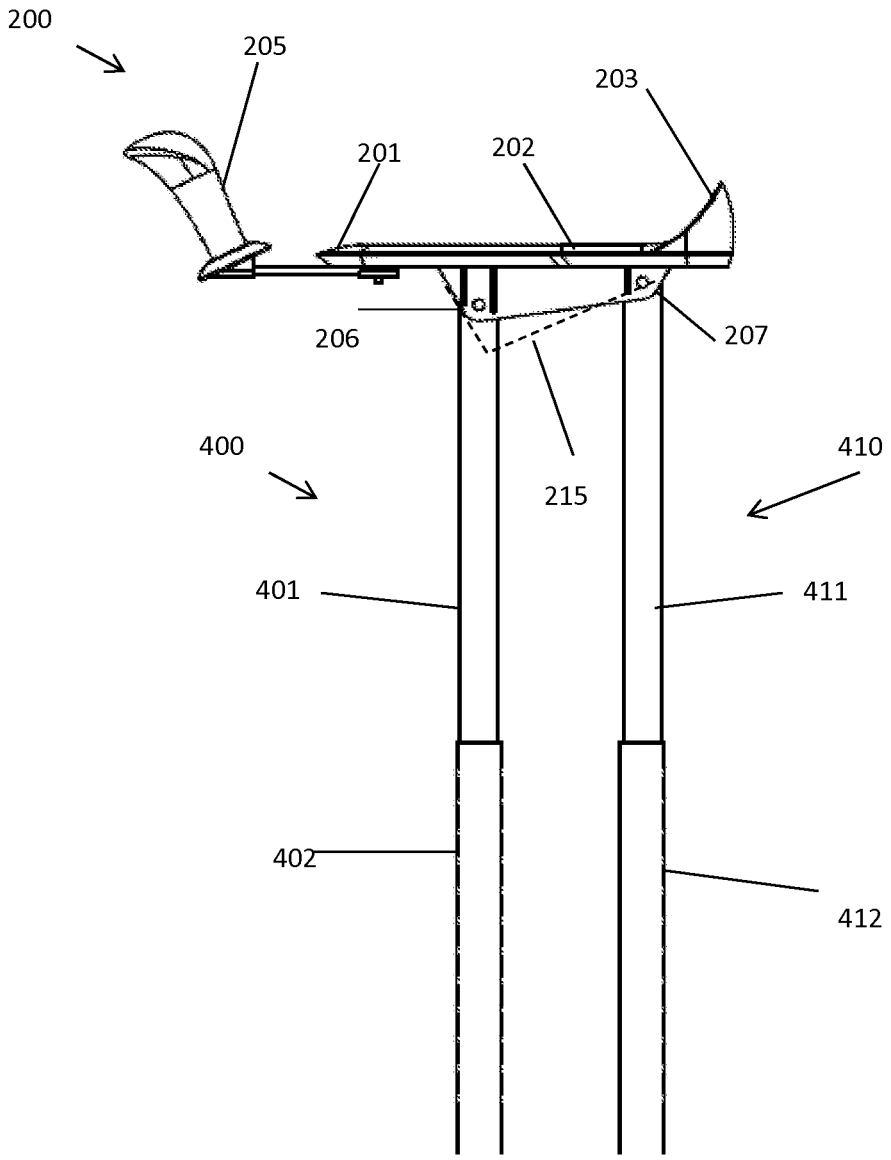
FIG. 7 is an illustration of a side view of one embodiment of the upper portion of the cane and shows how the handle and shaft are adjustable.

FIG. 7 is an illustration of a side view of one embodiment of the upper portion of the cane and shows how the handle and shaft are adjustable. As shown in FIG. 7, one embodiment of the upper portion of the cane 100 preferably includes: vertical shafts 400, 410 and handle 200; wherein the handle 200 is generally attached to the vertical shafts 400, 410. The vertical shafts 400, 410 preferably include: upper shaft portions 401, 411 and lower shaft portions 402, 412. The handle 200 preferably include: joints 206, 207; grip 205; front portion 201; middle portion 202; and elbow rest (or cup) 203. The joints 206, 207 preferably allow the handle 200 to be adjusted placed in various angles or configurations, including horizontal, incline, and decline 215. Preferably, the grip 205 allows the user to grasp a portion of the handle while walking with the cane 100. The front section 201, middle section 202, and elbow-rest 203 preferably provide areas where the user may lay or rest his or her forearm. In one embodiment, the front section 201 may be designed such that a user can grip section 201 or 202, or grip 205 with either the right or left hand. Preferably, the front section 201 will have an ergonomically designed grip with a raised palm in the center and thumb resting places on either the left or right side. The middle arm section 202 may preferably have a center groove, allowing for the arm to rest comfortably along its longitudinal axis. The middle arm section 202 may also be small enough to be gripped by a hand of the user if desired. The rear elbow section 203 preferably provides a concave design to allow an elbow of a user to rest comfortably. While FIG. 7 shows a forward grip attached to the front section and concave design approximately near the elbow-rest section, it should be understood that many types and configurations may be used. For example, the handles and coverings may be rigid, molded handles, rigid handles with soft outer coverings, flexible and rigid handles that do not require joints to move, and others. Generally, the devices for providing stable, sturdy, comfortable handles are determined by stability requirements for typical users, aesthetics, comfort, quality of construction, costs, and size requirements.

Preferably, handle 200 is constructed from wood, polyurethane, plastic, polymer metal, fiberglass, or any other combination of thereof to provide a rigid, comfortable, and stable handle. The front section 201, middle section 202, and elbow-rest 203 are preferably axially disposed around handle 200 and may be constructed of any material, such as a polymer (as preferred) and may include other materials as well such as plastic, padding, foam, fabric, hook and loop fabrics, polymer, thermoplastic polymer, or any material that provides both comfort and low wear qualities. Portions of the handle 200 may also be shaped to provide proper orientation for the user's hand and ergonomic safety and comfort for long and repeated use. The grip 205 is preferably made of a resilient material such as Thermoplastic Elastomer (TPE), silicone, or urethane, and is preferably used to allow the user to control the direction of travel. While, FIG. 7 only shows the vertical shafts 400, 410 and handle 200, it should be understood that additional components may be used such as a stability bar, which is generally an additional handle that is positioned below handle 200. The stability bar may also be set to a vertical height allowing for users in a seated position to utilize the stability bar as a handle for assistance in standing. Further, any connection device or system may be used without deviating from the scope of the invention.

Figure 8:
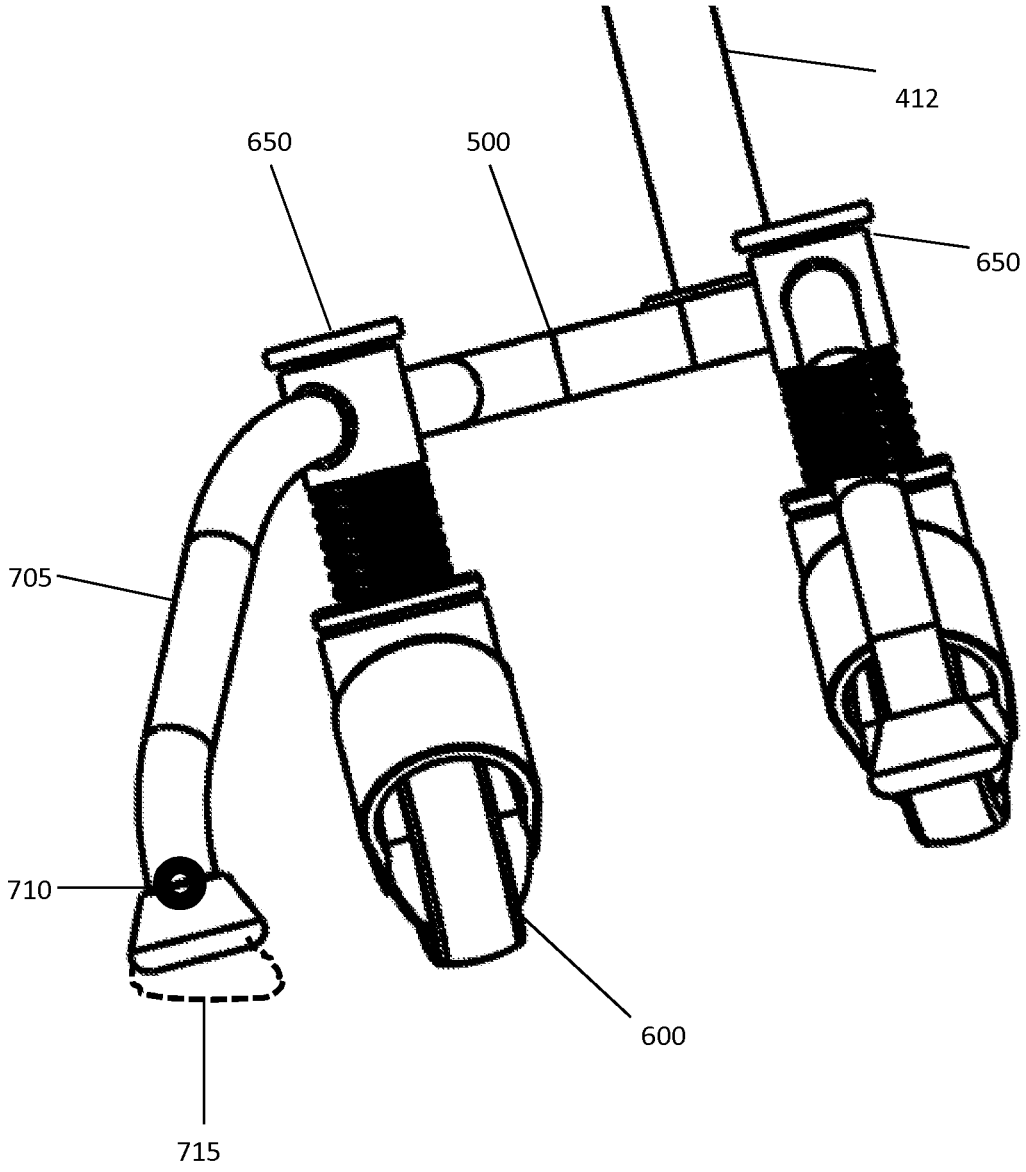
FIG. 8 is a detailed illustration of a front view of one embodiment of the lower portion of the cane and shows that the rigid supporting structures are flexible.

FIG. 8 is a detailed illustration of a front view of one embodiment of the lower portion of the cane and shows that the rigid supporting structures are flexible. As shown in FIG. 8, one embodiment of the lower portion of the cane 100 preferably includes: lower shaft portion 412, base 500, front wheels 600, wheel bases 650, and rigid support structures 705. The each rigid support structure 705 (or 700) may include a flexible joint 710, and a flat bottom 715. The flexible joint 710 is preferably a reinforced, flexible memory spring ball socket. The flat bottom 715 of the rigid support structures 700 generally provide substantial braking and stability when the flat bottom 715 contacts the ground through tilting, as shown, or when one or more of the four wheels are retracted. The cane 100 preferably has an angle between the distal edge of the rigid support structures 700 and the proximal contact point between the ground surface and the wheel 600. Because the rigid support structures 700 are relatively close to the ground, the angle is preferably small. When the vertical shafts 401, 410 are tilted at a large angle, the rigid support structures 700 typically contact with the ground surface. Additionally, when the rigid support structures 700 contact the ground, the wheeled movement of the cane 100 stops even if a user tilts the cane beyond the preferably small angle.

FIG. 8 also shows that the flexible joint 710 and flat bottom 715 allow the rigid support structure 700 to flex when contacting the ground. Specifically, rather than having the edge portion of the flat bottom 715 contact the ground, the full bottom surface of the flat bottom 715 preferably contacts the ground to provide more stability and braking.

Figure 9:
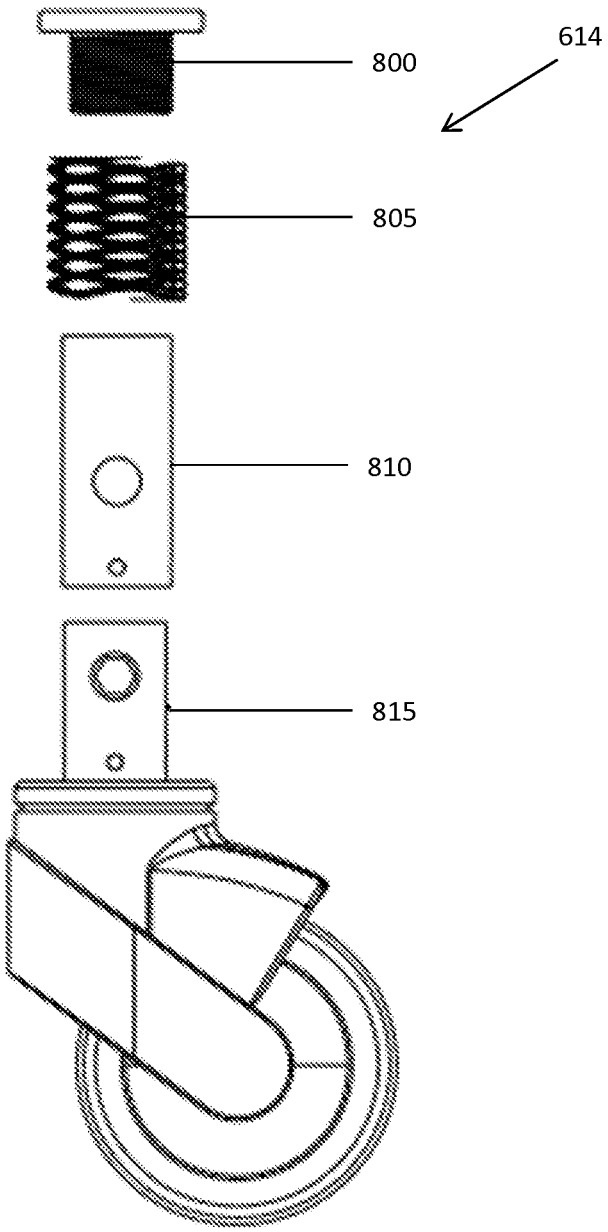
FIG. 9 is an exploded illustration of one embodiment of a wheel assembly and shows the integral parts of the wheel assembly.

FIG. 9 is an exploded illustration of one embodiment of a wheel assembly and shows the integral parts of the wheel assembly. As shown in FIG. 9, the wheel assembly 614 preferably is comprised of a spring tension adjustment knob 800, spring 805, caster sleeve 810, and caster 815. The caster assembly 614 preferably allows the caster to lift up when the user presses down on the wheel assembly 614, allowing the flat bottom 715 to engage the ground. The spring tension adjustment knob 805 preferably allows the user to adjust the tension required to push down the foot pads 715 to the ground. The spring 805 preferably biases the foot pads 817 away from the ground to allow the cane 100 to stay upright when adequate downward forces are not present. The caster sleeve 810 preferably connects to the caster 815 and allows the caster to bias vertically within the cane 100. The caster sleeve 810 includes a small keyway to keep the caster 815 axially aligned. The caster 815 preferably has a locking element built-in, which may include a direction lock. When engaged, the locking element preferably locks the caster and prevents the castor from swiveling about the base.

Figure 10:
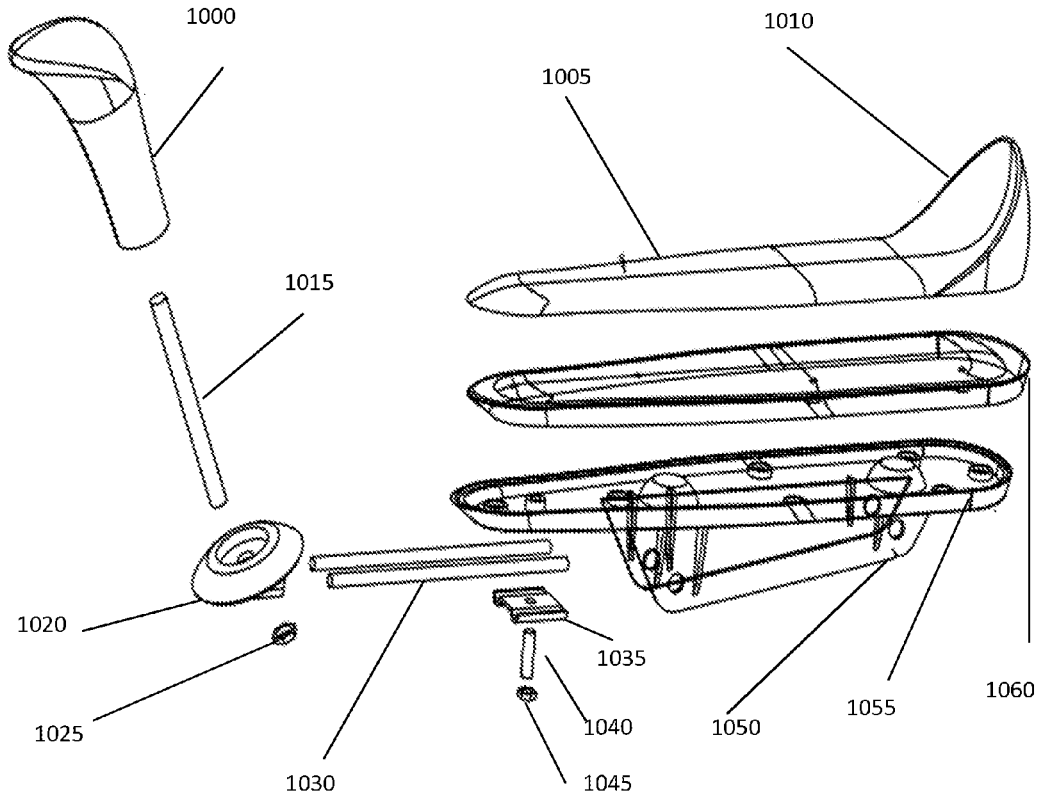
FIG. 10 is an exploded illustration of one embodiment of the handle.

FIG. 10 is an exploded illustration of one embodiment of the handle. As shown in FIG. 10, the handle 200 preferably includes: a grip 1000; main arm rest 1005; elbow rest 1010; mounting bolt 1015; mounting plate 1020; securing nut 1025, adjustment rail 1030; adjustment clamp 1035; threaded bolt 1040, adjustment locking nut 1045, mounting point 1050; frame 1055, and armrest underbody 1060. The main arm rest 1005 and elbow rest 1010 preferably attaches onto the armrest underbody 1060 and is typically where the user rests his forearm and elbow when using the cane 100. The grip 1000 is preferably made of a resilient material such as thermoplastic elastomer, silicone, or urethane and provides the user with a grasping mechanism when guiding the cane 100. The grip

1000 is preferably secured by the mounting bolt 1015, which preferably attaches through the mounting plate 1020 with a securing nut 1025. The mounting plate 1020 preferably functions as a large collar for a hand rest when the user grabs the grip 1000. The adjustment rail 1030 is preferably affixed to the grip mounting plate 1020 which preferably allows the forward grip 1000 to be adjusted at various arm lengths. The adjustment clamp 1035 is preferably held in place by the threaded bolt 1040 and the adjustment locking nut 1045. Preferably, if the adjustment locking nut 1045 is loosened, the adjustment rails 1030 are capable of sliding, thereby allowing the grip 1000 to adjust at the various different arm lengths. The armrest frame 1055 is preferably injection molded and acts as a fixation point for the vertical shafts 400, 410.

Unless otherwise stated, all measurements, values, ratings, positions, magnitudes, sizes, locations, and other specifications which are set forth in this specification, including in the claims which follow, are approximate, not exact. They are intended to have a reasonable range that is consistent with the functions to which they relate and with what is customary in the art to which they pertain.

The foregoing description of the preferred embodiment of the invention has been presented for the purposes of illustration and description. While multiple embodiments are disclosed, still other embodiments of the present invention will become apparent to those skilled in the art from the above detailed description, which shows and describes illustrative embodiments of the invention. As will be realized, the invention is capable of modifications in various obvious aspects, all without departing from the spirit and scope of the present invention. Accordingly, the detailed description is to be regarded as illustrative in nature and not restrictive. Also, although not explicitly recited, one or more embodiments of the invention may be practiced in combination or conjunction with one another. Furthermore, the reference or non-reference to a particular embodiment of the invention shall not be interpreted to limit the scope the invention. It is intended that the scope of the invention not be limited by this detailed description, but by the claims and the equivalents to the claims that are appended hereto.

Except as stated immediately above, nothing which has been stated or illustrated is intended or should be interpreted to cause a dedication of any component, step, feature, object, benefit, advantage, or equivalent to the public, regardless of whether it is or is not recited in the claims.

What is claimed is:

1. A cane comprising:

at least one substantially vertical member;

at least one handle;

a base;

four wheels; and four rigid support structures;

wherein said base is comprised of four wheel bases;

wherein said at least one handle is attached to a top end of said at least one substantially vertical member;

wherein a lower end of said at least one vertical member is attached to a top surface of said base;

wherein each of said four wheels is attached to one of said four wheel bases;

wherein each of said four rigid support structures is attached to said base distally to each of said four wheels;

wherein said four wheels extend from a bottom surface of said base and wherein said four wheels extend further away from said base than said four rigid support structures, such that said cane rolls along a ground surface being traversed by a user without said four rigid support structures contacting said ground surface;

wherein said four rigid support structures are fail-safe brakes;

wherein each of said at least one four wheels is retractably connected to one of said four wheel bases, such that when a force is applied downwards on said at least one substantially vertical member, said four wheels retract into said four wheel bases such that said four rigid support structures contact said ground surface;

wherein said base is substantially rectangular and has four corners;

wherein said four wheel bases are positioned substantially at said four corners of said base; and wherein said four rigid supporting structures are positioned substantially at said four corners of said base and extend distally beyond said four wheels such that when said cane is tilted away from said substantially vertical position in any direction one or more of said four rigid supporting structures will come into contact with said ground surface.

2. The cane of claim 1, wherein each of said four rigid support structures is comprised of a flexible base and a substantially flat bottom, such that said four rigid support structures provide substantial braking and stability when one or more of said four wheels are retracted.

3. The cane of claim 2, wherein said at least one substantially vertical member is comprised of two vertical shafts, wherein a height of each of said two vertical shafts is independently adjustable.

4. The cane of claim 3, wherein said at least one handle is slideably attached to said two vertical shafts such that said at least one handle may shift from a substantially level position to one or more tilted positions.

5. The cane of claim 4, wherein said two vertical shafts are removeably attached to said top surface of said base.

6. The cane of claim 5, wherein said one or more of said four wheel bases are comprised of one or more adjustment devices;

wherein said one or more adjustment devices allow said user to adjust said downward force needed to retract one or more of said four wheels into said four wheel bases.

7. The cane of claim 6, wherein two of said four wheels are fixed axle wheels and wherein two of said four wheels are swivel wheels.

8. The cane of claim 7, wherein each of said four wheel bases is further comprised of a compression spring;

wherein said compression spring allows each of said four wheels to retract into one of said four wheel bases.

9. A cane comprising:

two substantially vertical shafts;

at least one handle;

a base;

four wheels; and four rigid supporting structures;

wherein said base has four corners and is comprised of four wheel bases;

wherein said four wheel bases are positioned substantially at said four corners of said base;

wherein said at least one handle is attached to a top end of each of said two substantially vertical shafts;

wherein a lower end of each of said two substantially vertical shafts are removeably attached to a top surface of said base;

wherein each of said four wheels is attached to one of said four wheel bases;

wherein said four rigid supporting structures are positioned substantially at said four corners of said base and extend distally beyond said four wheels;

wherein said four wheels extend from a bottom surface of said base and wherein said four wheels extend further away from said base than said four rigid supporting structures such that said cane rolls along a ground surface being traversed by a user without said at least one four rigid supporting structures contacting said ground surface, and such that when said cane is tilted away from a substantially vertical position in any direction one or more of said four rigid supporting structures will come into contact with said ground surface;

wherein each of said four wheels is retractably connected to one of said four wheel bases, such that when a force is applied downwards on said vertical shafts, one or more of said four wheels retract into one or more of said four wheel bases, such that one or more of said four rigid support structures contact said ground surface;

wherein said four rigid supporting structures are a fail-safe brake; and wherein a height of each of said two vertical shafts is independently adjustable.

10. The cane of claim 9, wherein said at least one handle is slideably attached to said two vertical shafts such that said at least one handle may shift from a substantially level position to one or more tilted positions.

11. The cane of claim 10, wherein one or more of said four wheel bases are comprised of one or more adjustment devices;

wherein said one or more adjustment devices allow said user to adjust said downward force needed to retract one or more of said four wheels into one or more of said four wheel bases.

12. The cane of claim 11, wherein each of said four rigid support structures is comprised of a flexible base and a substantially flat bottom, such that said four rigid support structures provide substantial braking and stability when one or more of said four wheels are retracted.

13. The cane of claim 12, wherein each of said four wheel bases is further comprised of a compression spring;

wherein said compression spring allows each of said four wheels to retract within one of said four wheel bases.

14. The cane of claim 13, wherein two of said four wheels are fixed axle wheels and wherein two of said four wheels are swivel wheels.

* * * * *